United States Patent [19]

Ando

[11] 3,992,196

[45] Nov. 16, 1976

[54] METHOD AND APPARATUS FOR THE CONTINUOUS REFINING OF IRON AND ALLOYS

[75] Inventor: Ryo Ando, Kawasaki, Japan

[73] Assignee: Nippon Kokan Kabushiki Kaisha, Tokyo, Japan

[22] Filed: June 13, 1972

[21] Appl. No.: 262,249

[30] Foreign Application Priority Data

June 25, 1971 Japan ..... 46-45617

[52] U.S. Cl. ..... 75/61; 75/53

[51] Int. Cl.[2] ..... C21C 7/00

[58] Field of Search ..... 75/53, 61, 58, 52

[56] References Cited

UNITED STATES PATENTS

| | | | |
|---|---|---|---|
| 3,110,939 | 11/1963 | Lockwood | 75/61 |
| 3,197,306 | 7/1965 | Osborn | 75/53 |
| 3,350,196 | 10/1967 | Bashford | 75/52 |
| 3,393,997 | 7/1968 | Faste | 75/61 |
| 3,576,320 | 4/1971 | Faste | 75/61 |
| 3,576,321 | 4/1971 | Faste | 75/61 |
| 3,598,573 | 8/1971 | Freissmuth | 75/55 |

*Primary Examiner*—Peter D. Rosenberg

*Attorney, Agent, or Firm*—Flynn & Frishauf

[57] ABSTRACT

Molten pig iron is desulfurized, dephosphorized or otherwise refined by continuously admitting the molten pig iron into a stirring tank having an oval horizontal cross-section, causing the molten pig iron to flow in the longitudinal direction of the tank. An additive is incorporated into the stirring tank. Portions of the pig iron near the interface between the same and the additive are stirred by means of a plurality of vertical stirring rods or vanes which are suspended above the tank and project into the molten pig iron. Adjacent stirring rods or vanes are rotated in opposite directions such that their loci of rotations overlap with each other.

8 Claims, 14 Drawing Figures

METHOD AND APPARATUS FOR THE CONTINUOUS REFINING OF IRON AND ALLOYS

BACKGROUND OF THE INVENTION

This invention relates to a method and apparatus for the continuous refining of iron or iron alloys by continuously conducting desulfurization or dephosphorization of the molten pig iron discharged from a blast furnace or by the continuous manufacture of the case iron by adding ferrosilicon.

Demand for steel of low sulfur content, for example of less than 0.005% or less than 0.015% has recently been increased. On the other hand, a decrease in the coke ratio is strongly desired from the standpoint of the shortage of the supply of coking coal. For this reason, heavy oil or other liquid fuel is used to save coke consumption in the blast furnace. But due to shortage of heavy oil of low sulfur content it is inevitable that pig iron containing a large quantity of sulfur is produced. Consequently, it is highly desirable to provide an efficient method and apparatus capable of readily removing sulfur from a large quantity of molten pig iron or steel.

Phosphorus has also been considered one of the harmful elements as sulphur. However, phosphorus can be relatively readily removed by the basic steel making operation and a number of methods for this purpose have been proposed. Thus phosphorus did not present any serious problem. However, demand for steel of low phosphorus content has also increased because it was found that in high tension steels, especially having a tensile strength of 80 kg/mm$^2$, decrease in the phosphorus content is an efficient means for preventing the formation of weld cracks. As above described, it has been considered that the dephosphorization of steel is relatively easy but due to the increase of the size of LD converters, the conventional method of dual slag removal has become difficult to practice. Further, the method of increasing basicity beyond a normal value is not always an effective process because this method increases the losses of iron and heat.

While the above description refers to a case wherein molten pig iron is used as the raw material for manufacturing steel, the method of preparing cast iron for use of casting from pig iron originally intended to manufacture steel has recently become noteworthy. The pig irons for casting and steel making are different in the content of silicon. More particularly, the content of silicon in the steel making is about 0.7%, whereas in the latter it is more than 2%. For this reason, it is possible, theoretically, to convert the pig iron for steel making into the cast iron by addition of ferrosilicon. However, this method has not been practiced widely since it is necessary to consider other compositions and various other factors. Accordingly, it has been the practice to manufacture the cast iron by using a relatively small blast furnace intended for its purposes only, or to prepare the two different types of pig iron alternatively in one blast furnace.

However, recent tendency of increasing the capacity of blast furnaces makes it impractical to alternately prepare the pig iron for steel making and the cast iron for casting. Accordingly, it is necessary to use small blast furnaces for preparing the cast iron, but the use of such small blast furnaces cannot reduce the manufacturing cost as in the case of using large size blast furnaces.

Of course, it may be possible to prepare the cast iron with a large blast furnace. However, recent increase in the production capacity of a single blast furnace is much larger than the increase in the demand of cast iron. Therefore, if it were possible to efficiently convert the pig iron for steel making into the cast iron, it would be possible to meet the gradual increase in the demand of cast iron and to fully enjoy the advantage of the large capacity blast furnace. From the standpoint of engineering, it is possible to add ferrosilicon at a high efficiency yield to the molten pig iron, but the resulting cast iron contains phosphor of below a certain limit because it is impossible to sufficiently dephosphorize.

In addition, the resulting cast iron does not contain sufficient quantities of various valuable compositions, such as Cr, Ti, V, S, etc. which are essential to ductile cast iron, for example, the demand thereof increasing rapidly in recent years.

To this end, although a number of methods of desulphurization have been proposed in the past, so long as the applicant is aware, no proposal has actually been practiced. Most noteworthy reasons common to these prior methods are as follows. Because a large quantity of pig iron is treated at a time, the useful life of the container or the like is relatively short, thereby requiring frequent repairs and because the close contact between a desulfurization agent and the molten pig iron is not possible with the large amount of desulfurization that is required. Thus, it is necessary to use a large quantity of the desulfurization agent. Moreover, a shallow depth of the molten pig iron in a tank for heating the same and a short contact interval between the desulphurization agent and the molten pig iron cannot assure sufficient desulphurization. Accordingly, it is necessary to provide an extremely wide surface area of the molten pig iron in order to attain a high percentage desulfurization. For example, in a method of using an electromagnetic pump for stirring the molten pig iron by magnetic field, it was found that the percentage of desulfurization was only about 50% throughout the entire length of vessel, having a total length of 6 m. FIG. 1 is a schematic representation of the apparatus to work out the method proposed by Rhein Stahl Aktiengesselshaft of West Germany which is said to be the most efficient method available at present.

This method shows a fairly high percentage of desulfurization in spite of shallower depth of the molten pig iron when compared with other methods. More particularly, as shown in FIG. 2, (a) when 5 to 7 kg calcium carbide per ton of molten pig iron is used as the desulphurization agent, the percentage of desulphurization amounts to 70%, and (b) when 9 to 10 kg and (c) 13 to 14 kg of the desulphurization agent per ton of molten pig iron are used, the percentage of desulphurization amounts to 82% and to about 90%, respectively.

According to the manufacturer's announcement, the apparatus shown in FIG. 1 has an inner diameter of two meters, the depth of the molten pig iron of about 30 cm, flow quantity of the pig iron of 6 tons/min and an average residence time of the pig iron in the treating tank of a little less than one minute. The reason that the apparatus can realize a relatively good result notwithstanding such a short residence time is considered as caused by a good stirring action.

SUMMARY OF THE INVENTION

It is an object of this invention to provide a novel method of refining molten pig iron without the necessity of stirring the entire body of the molten pig iron.

Another object of this invention is to provide a novel method and apparatus for desulfurization, dephosphorization, desilication or addition of silicon, etc., which can assure sufficient residence times for efficient refining and prevent wear of the refining apparatus.

According to one aspect of the invention there is provided a method of continuous refining of iron and iron alloys comprising the steps of continuously admitting molten pig iron into a stirring tank from one side thereof, the stirring tank having an oblong horizontal cross-section and being provided with a plurality of parallel spaced apart vertical stirring means disposed in the longitudinal direction of the oblong cross-section, discharging the molten pig iron from the opposite side of the stirring tank thereby causing the molten pig iron to flow in the longitudinal direction, incorporating an additive into the stirring tank and rotating said stirring means for stirring the portions of the molten pig iron near the interface between the same and the addition, thereby effecting perfect admixture of the molten pig iron in the stirring tank due to the flow of the molten pig iron and admixture of the additive with the molten pig iron at the portions thereof near the interface by the rotation of the stirring means.

According to another aspect of the invention, there is provided an apparatus for continuously refining iron and iron alloys comprising a stirring tank having an oblique horizontal cross-section, inlet and outlet ports for the molten iron, the inlet and the outlet ports being positioned in the longitudinal direction of the horizontal cross-section, thereby causing the molten pig iron to flow in the longitudinal direction, a plurality of parallel spaced apart vertical stirring means suspended from an upper part of the apparatus into the upper portion of the molten pig iron contained in the stirring tank, the stirring means being arranged in the longitudinal direction, and means for rotating the stirring means in the opposite direction such that their loci of rotations overlap with each other.

For dephosphorization, the stirring tank is provided with oxygen lances, preferably concentric with the driving shafts for the stirring means.

The stirring means takes the form of rods or vanes of graphite or other refractory material, such as zirconium.

To remove slag formed during the refining operation, a suitable slag removing device is provided at or near the outlet port of the treated molten pig iron.

BRIEF DESCRIPTION OF THE DRAWINGS

The invention can be more fully understood from the following detailed description taken in conjunction with the accompanying drawings in which.

Throughout the drawings like or corresponding elements are designated by the same reference numerals.

DESCRIPTION OF THE PREFERRED EMBODIMENTS

Two conditions, namely "the stirring of the whole molten pig iron" and "the stirring of the portions near the interface between the molten pig iron and the desulfurization agent" have been considered as the essential conditions for efficient desulfurization. In the prior art method of desulfurization, especially in the method of desulfurization of the batch type, various measures have been adopted to promote these two conditions.

As a result of an extensive research it was found that there is a natural flow in the body of molten pig iron after it has been transferred into a vessel so that it is not necessary to forcibly stir the molten pig iron and that sufficient stirring of the portions near the interface is essential, (which fact has been overlooked heretobefore). Further, it was confirmed that such stirring of the portions of the molten pig iron near the interface is necessary not only in the preparation of the cast iron for casting by the addition of ferrosilicon in the molten pig iron but also in the dephosphorization of the molten pig iron by using a lance.

Based on this discovery the following tests have been conducted, in which water models were used for the purpose of finding out various conditions required for the continuous treatment of the molten pig iron. More particularly, in the continuous treatment, the time for treating is reduced as the molten pig iron flows from the inlet to the outlet of a tank. If the flow rate were increased with respect to the size of the tank, it would be possible to reduce the retention time as desired. Accordingly, following tests utilizing water models were carried out for the purpose of finding out a condition to assure sufficient mixing of the pig iron in the tank under the reduced retention time condition. In these tests, the most suitable conditions regarding the configuration of the tank, positions of the inlet and outlet ports for the molten pig iron and the stirring were investigated.

Figure 3:
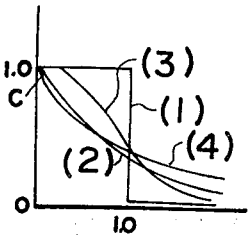
FIG. 3 is a graph showing the variation in the concentration with time obtained by water model tests.

When fluid is passed through a tank, it always accompanies a mixing action. Generally, when liquid flows through a tank at a definite rate, there occur many types of flows including (1) a piston flow, (2) complete admixture, (3) a combination of the piston flow and the complete admixture and (4) a flow including a partial dead space or a through flow. In the experiments, V liter of one liquid having a concentration C was contained in a tank and another liquid having a concentration zero was admitted into the tank through the inlet at a rate of v liter per minute and the concentration of the mixture sampled at the outlet was measured. The results of the measurements were plotted in FIG. 3 in which 1 indicates a model of the piston flow wherein liquids having concentrations C and O flow separately through the tank and the interface between the two liquids approaches to the outlet with time. $V/v = \theta$ represents the mean retention time and in the case of the piston flow, the concentration changes from C to O after the elapse of the retention time. Curve 2 indicates the model of the complete admixture. In this case, at the instant when the liquid having concentration O is admitted into the tank the two liquids are admixed homogeneously. As the concentration varies exponentially, when a logarithmic scale is used for the concentration, the relation between the mean retention time $\theta$ and the concentration can be shown by a straight line. Curve 3 represents the model of the combination of the piston flow and the complete admixture in which case the completely admixed liquids flow like a piston flow by being partitioned by an invisible partition wall. It is known that, as the number of supposedly subdivided tanks increases, the curve drawn on a rectangular cordinates whose ordinate represents the concentration whereas the abscissa the mean retention time $\theta$ approaches the vertical. Stated in another way, when the number of the subdivided tanks increases to infinity, the flow becomes a piston flow. In this manner, with the water model tests, the mixing characteristic in the tank can be determined by measuring the variation with time in the outlet concentration. For this purpose, the concentration of the liquid was varied momentarily at the inlet and the corresponding variation in the concentration was measured at the outlet.

In both batch type and continuous flow type, important conditions for desulfurization are "the stirring of the entire molten pig iron" and "the stirring of the portions of the molten pig iron near the interface between it and the desulfurization agent" mentioned hereinabove. The purpose of the water model tests is to find out a method which can obtain the stirring of the entire body of molten pig iron with the smallest possible vessel under a condition in which a nearly perfect admixture can be assured even when a large quantity of the molten pig iron is passed and, a method which can assure substantially completely admixed condition even when the flow quantity varies, where the molten pig iron is discharged non-continuously. Although shorter retention times are preferred, a time period of two minutes was selected in view of the high percentage of desulfurization. This value was determined with reference to the mean retention time of the prior art method of desulfurization. Next it is necessary to determine "the stirring of the portions near the interface between the molten pig iron and the desulfurization agent". However, since this stirring can be readily attained by stirring the portions of the molten pig iron near the interface with a stirring rod, the water model test for this case was omitted. Next problem to be determined was the problem of scale-up. However, as this problem was extremely complicated, a model having dimensions substantially equal to those of the practically used apparatus was used in the test.

Figure 4:
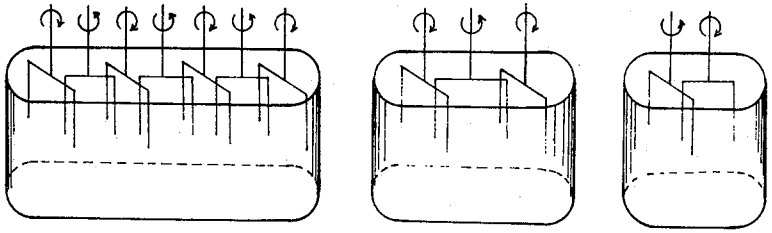
FIG. 4 shows perspectives views of three types of stirring tanks used in the water model tests.

As diagrammatically shown in FIG. 4, a plurality of stirrers with their vertical driving shafts disposed on a straight line were provided. The numbers of shafts were 7, 3 and 2, respectively. Two parallel spaced apart stirring rods were mounted on each driving shaft with the rotary regions or loci of rotation of the stirring rods on adjacent driving shafts overlapping slightly. Each driving shaft was rotated at a speed of 100 r.p.m. and the stirring rods were dipped into a depth of about 20 cm in water. The width of the tank was 50 cm and the spacing between adjacent two driving shafts was 30 cm. The depth of the water in the tank was about 70 cm. The bottom of the tank was flat, but tanks having bottoms of different configurations were also used. The positions of the inlet and outlet for the water were also varied. Several flow rates were selected in a range of the mean retention time of from 1.5 to 15 minutes. The tests were conducted by colouring the water in tank with a dye (Safranine T), then admitting water into the tank and the concentration of the dye in the water sampled at the outlet was measured by using a colorimeter. The measurement was also carried out several times without rotating the driving shafts and the results were compared with those obtained when the driving shafts were rotated.

Briefly stated, the following results were obtained:

1. Even when the length of the tank and the number of the driving shafts were increased, the results were not always improved.
2. The effect of the positions of the inlet and the outlet of the water is relatively large and it was found that the most advantageous results can be obtained when the inlet and the outlet were arranged such that the water flows in the longitudinal direction of the horizontal cross-section of the tank.
3. Generally, the result is different dependent upon the mean retention time but there is no resulting influence of the length of the repetition time.
4. The variation in the configuration of the tank bottom results in a considerably improved effect.

The best result was obtaind where three driving shafts were used and where the inlet and the outlet were positioned to cause the water to flow in the longitudinal direction of the horizontal cross-section of the tank. A retention time of 2 minutes or more showed a condition of a nearly perfect admixture.

Figure 5:
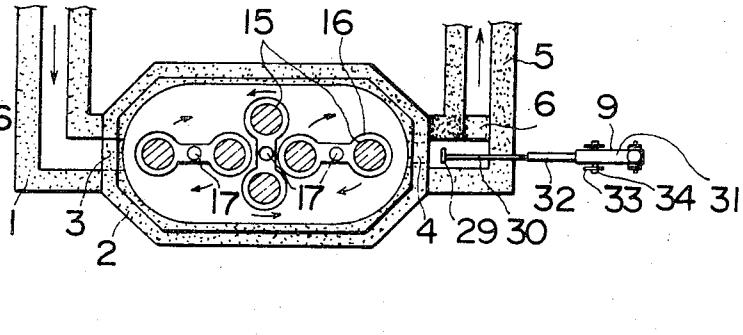
FIG. 5 shows a cross-sectional view of an apparatus embodying the invention for desulfurizing molten pig iron taken along a line V—V in FIG. 6.
Figure 6:
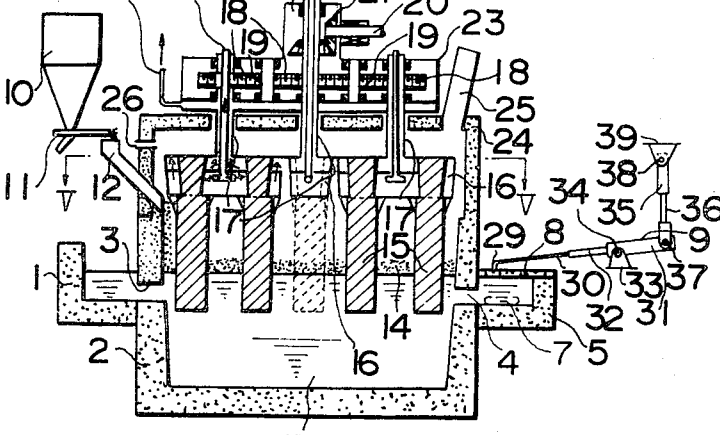
FIG. 6 shows a longitudinal sectional view of the stirring tank shown in FIG. 5.

Bassed on the aforementioned results, an apparatus for desulfurizing molten pig iron as shown in FIGS. 5 and 6 was constructed. In these drawings, the molten pig iron supplied from a blast furnace or a torpedo car (not shown) is admitted into a stirring tank 2 through an inlet port 3 indicated by an arrow. On the opposite side of the inlet port 3, the tank 2 is provided with an outlet port 4 to discharge the treated molten pig iron to a ladle or the like container via a trough 5. A skimmer 6 is provided in the trough 5 for discharging the treated pig iron through an opening 7. The spent desulfurizing agent 8 or the slag which is discharged together with the treated pig iron is removed by a scraper 9.

The desulfurization agent is stored in a hopper 10 and a constant quantity of the agent is fed by a vibrating feeder 11 and is then incorporated into the molten pig iron in tank 2 via a chute 12. The desulfurization agent 14 floating on the molten pig iron in the tank is distributed in the body of the molten pig iron when vigorously stirred by stirring rods 15, thereby desulfurizing the molten pig iron. Two stirring rods 15 are mounted on each of fixtures 16. In a large capacity apparatus it is advantageous to use three stirring rods for each fixture with the rods situated at the apices of an equilateral triangle. A driving shaft 17 is connected to the center of each fixture 16. In the example shown in FIGS. 5 and 6 there are provided three driving shafts and the adjacent shafts are rotated in the opposite directions as shown by arrows. This arrangement permits as far as possible a close positioning of the shafts so as to overlap the loci of respective stirring rods.

Respective driving shafts 17 are provided with gears 18 which are interconnected through a gear 19. The driving force transmitted to a shaft 20 from an electric motor through a speed reduction mechanism, not shown, is transmitted to the central driving shaft 17 via bevel gears 21, 22 and thence to the driving shafts 17 on the opposite side thereof. These gears are contained in a gear box 23.

Since the molten pig iron of an elevated temperature of about 1400° C is stirred, it is necessary to provide a suitable heat insulation and it is also necessary to provide a suitable dust preventing means for treating the fume generated during the treatment. To this end, a cover 24 provided with an inner lining of heat resistant material and may be cooled with water is mounted on the stirring tank 2 for shielding the lower portions of the driving shafts 17 and the stirring rods 15 secured to the lower ends thereof. The cover 24 is provided with a vent pipe 25 for leading the collected fume to a dust precipitator, not shown. Further, a gas inlet opening 26 is provided through cover 24 to admit reducing or neutral atmospheric gas for improving the efficiency of the desulfurization or elongating the useful life of the stirring rods 15.

The fixtures 16 for supporting the stirring rods and the driving shafts 17 are cooled by water. More particularly, each shaft 17 comprises a double wall tube and the cooling water is admitted through the inner tube 27 and discharged through discharge pipe 28 after flowing through a passage as shown by arrows in FIG. 6.

The scraper 9 for removing the used desulfurization agent on slag is constructed as follows. Thus, a scraper plate 29 is mounted on one end of an operating rod 30 which is actuated by a piston 32 contained in a cylinder 31 pivotally mounted on a pin 34 supported by a pedestal 33. The lower end of the piston 36 of another cylinder 35 is connected to the outer end of cylinder 31 through a pin 37. The upper end of the cylinder 35 is secured to a stationary pedestal 39 through a pin 38. The scraper 9 is shown in a piston just to commence to scrape. In this position, only the piston 32 of cylinder 31 is operated to remove the spent desulfurization agent. Thereafter, the piston 36 is extended to rotate the operating rod 30 in the clockwise direction and then the piston rod 32 is extended. The piston rod 36 is retracted to the position shown in FIG. 6 thereby descending the scraper plate into the spent desulfurization agent or the slag and the operation is repeated.

The scraper 9 may be mounted at a suitable position other than indicated, for example on the trough 5.

Where the discharge opening 4 is positioned at the bottom of the tank 2, the slag is not always discharged with the treated molten pig iron so that it is necessary to provide a separate opening for discharging the slag at a position substantially at the same level as the upper surface of the molten pig iron 13.

Figure 7:
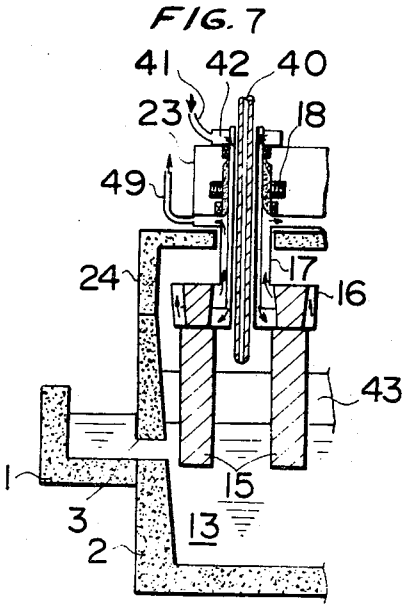
FIG. 7 shows a partial longitudinal sectional view of a modified stirring tank equipped with an oxygen lance.

A modified embodiment of the invention for dephosphorization is shown in FIG. 7. This modification is substantially identical to the previous embodiment except that a lance 40 for admitting oxygen is contained in the center of hollow shaft 17. The oxygen lance 40 has the same construction as that commonly used for an LD converter and is cooled by water.

Since the lance is contained in shafts 17, it is necessary to increase the diameter thereof and to use an independent feed water pipe 41. Further, a fixture 42 is secured to the upper end of shaft 17 to supply cooling water into the interior thereof. The cooling water flows as shown by arrows and is discharged through a discharge pipe 49.

Figure 8:
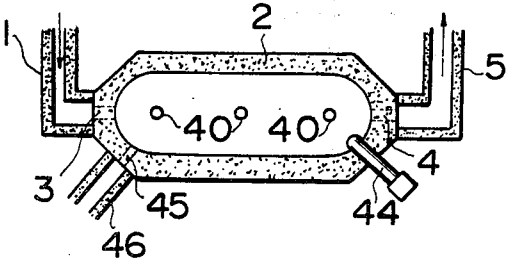
FIG. 8 is a diagrammatic cross-sectional view of a stirring tank showing a trough for incorporating a dephosphorizing agent and for discharging slag.

The dephosphorization agent consists essentially of lime, fluorspar, mill scale, iron ore and these ingredients melt to form a slag layer 43. Different from the desulfurization process, the dephosphorization agent is incorporated through a chute 44 (FIG. 8) or through the lance 40 together with oxygen or through chute 44 and lance 40. As shown in FIG. 8, the chute 44 is located near the discharge opening 4 for the treated pig iron such that it admits the dephosphorization agent in a direction opposite to the direction of the flow of the molten pig iron. It is advantageous to locate the slag discharge opening 45 close to the inlet opening 3 for the molten pig iron to be treated. The slag is discharged through a spout 46 where the discharge opening 4 for the treated pig iron is located near the bottom of tank 2, the same consideration as in the case of the above dephosphorization can be applied to desulphurization.

Figure 9:
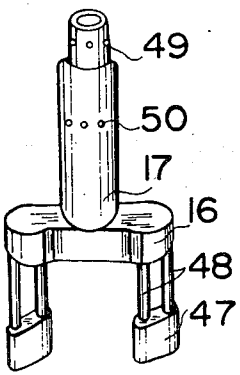
FIG. 9 is a perspective view of metal stirring vanes.
Figure 10:
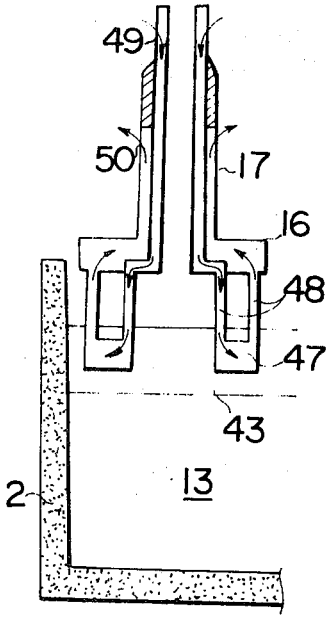
FIG. 10 is a longitudinal sectional view of the metal stirring vanes showing the passage of the cooling water.

For the dephosphorization process, it is necessary to construct the stirring rods 15 with different material. While graphite is preferred for desulfurization, since decarbonization occurs concurrently with dephosphorization, wear of the portions of the graphite rods immersed in the molten pig iron is significant. Accordingly, refractory materials of zirconium are preferred for dephosphorization. The construction of the stirring rods for this purpose is the same as the stopper for the ladle of steel making. Even with such a material when the percentage of dephosphorization is increased, the stirring rods wear to an extreme degree so that stirring vanes of metal shown in FIGS. 9 and 10 are preferred.

More particularly, metal vanes 47 are made of copper, for example, and their lower ends are dipped into the slag layer. A pair of vanes are secured to a fixture 16 through supporting rods 48. The hollow driving shaft 17 is cooled by cooling water which enters into the inside of the shaft 17 through upper openings 49 and after circulating through a passage as shown by arrows in FIG. 10 flows outwardly through openings 50.

The apparatus for desulfurization can also be used for incorporating ferrosilicon. Where dephosphorization has already been made as in the case of preparing ductile cast iron, the stirring rods are made of material suitable for dephosphorization.

Figure 11:
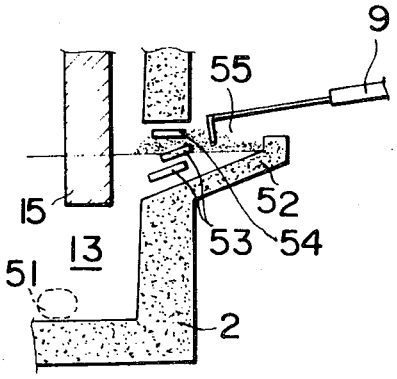
FIG. 11 is a partial longitudinal sectional view of the stirring tank provided with wave breaking plates at the discharge port of slag.

FIG. 11 is a partial sectional view showing an arrangement of the slag removing device 9 where the outlet port 51 for the treated pig iron is positioned near the bottom of the tank. More particularly, where the outlet port 51 is provided at the bottom and a window 52 for removing the slag is formed through the side wall of the tank, the surface of the molten pig iron will be at a level indicated by a dotted line. Since waves are formed on the surface of the molten pig iron when it is stirred vigorously by stirring rods it is advantageous to provide wave breaking plates 53 and 54 of carbonaceous material so as to prevent the waves from propagating to the outside of the tank, thereby enabling ready removal of the slag.

Various combinations of the tanks are possible. In one arrangement shown in FIG. 12 two tanks are arranged side by side and are connected in series through an opening 51. In this example, slag removing device 9 is provided for only one tank but the device 9 may be provided for both tanks in which case the opening 51 is positioned at the lower portions of the tanks.

Figure 13:
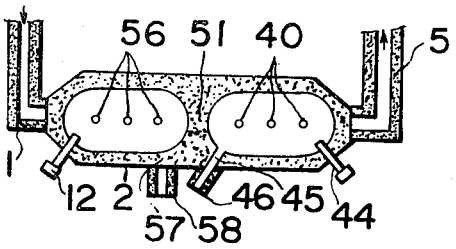

FIG. 13 shows another arrangement which is suitable for desilication prior to dephosphorization. Generally where pig iron is refined by blowing oxygen thereinto, the silicon removal reaction takes place prior to the dephosphorization reaction. Thus Si is oxidized to form $SiO_2$ which forms slag. For dephosphorization, slag having a basicity above a certain value is required to be present, but the quantity of lime and fluorspar to be added may be decreased as the quantity of $SiO_2$ is decreased, thus decreasing the loss of iron and decreasing the necessary heat quantity. There are provided oxygen lances 56 and 40 and the slag formed is discharged to the outside through a discharge opening 57 and spout 58. The molten pig iron flows into the other tank from one tank through opening 51. The dephosphorization agent is added into the righthand tank through oxygen lances 40 or chute 44 and the slag formed in this tank is discharged through the opening 45 and the spout 46.

Figure 1:
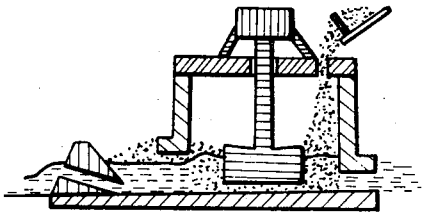
FIG. 1 is a diagrammatic sectional view of one example of the prior art desulfurization apparatus.
Figure 2:
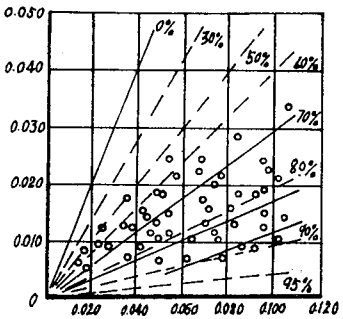
FIG. 2 is a graph showing the percentage of desulfurization according to the apparatus shown in FIG. 1.
Figure 14:
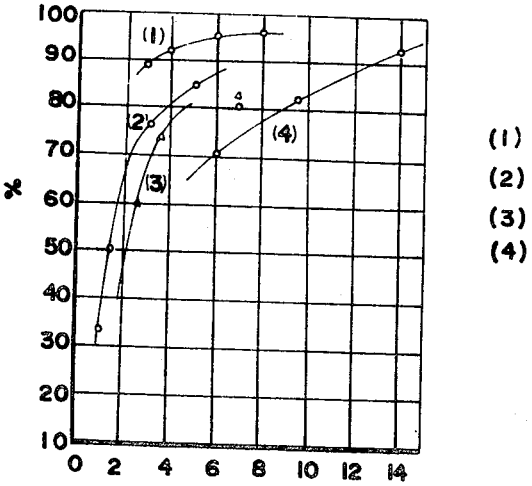

As shown in FIG. 14, according to this invention it is possible to desulfurize to the same extent by using about one half of calcium carbide when compared with the prior method shown in FIG. 1. In the method of FIG. 1, the flow rate of the molten pig iron is 6 ton/minute for a surface area of about 3 $m^2$, that is 2 $t/min/m^2$. The flow rate of this invention is the same. One of the reasons for this difference is the difference in the depth of the bath, that is 30 cm in the case of FIG. 1 and 60 cm in this invention. Assuming the same flow quantity per unit area, about twice the mean retention time will be obtained in the method of this invention. More particularly, in the method of FIG. 1 the mean retention time equal 1 minute, whereas according to the method of this invention, it is increased to 2 minutes. Although the reaction speed of calcium carbide with the sulfur in the molten pig iron is said to be high, twice the retention time greatly improves the degree of desulfurization.

Most of the cost of the desulfurization using calcium carbide is the cost of the calcium carbide so that a lesser quantity thereof is advantageous.

Since it is possible to increase the retention time by increasing the depth of the stirring bath over that used in the conventional continuous method, it is not only possible to improve the efficiency of desulfurization but also to increase the life of the tank. The flow velocity in the conventional continuous desulfurization process is considerably high, so that the service life of the tanks is shorter and the repair costly.

As above described, the stirring rods are readily worn. According to this invention the stirring rods of graphite electrode for ordinary electric furnaces may be used. Heretofore it has not been conceived to use graphite electrode because of its high price and brittleness. According to this invention, use of graphite electrode is possible. Since molten pig iron is substantially saturated with carbon, the wear of the graphite stirring rods caused by the molten pig iron is small. Instead, portions of the rods exposed to the air are worn by oxidation. However, the invasion of the air into the tank can be readily prevented by using a tank cover, thus increasing the life of the stirring rods.

It is, of course, to be understood that materials other than graphite can also be used.

Following examples are given for the purpose of illustrating the invention.

EXAMPLE 1

FIG. 14 shows the result of desulfurization by using the apparatus shown in FIGS. 5 and 6. In this example, the flow rates of the molten pig iron were 1 t/min and 2 t/min respectively, and calcium carbide was used as the desulfurization agent. The temperature of the molten pig iron was from 1450° C to 1400° C, and the content of sulfur of the molten pig iron before treatment was from 0.060 to 0.030%. The speed of the driving shafts was 75 r.p.m.

EXAMPLE 2

Figure 12:
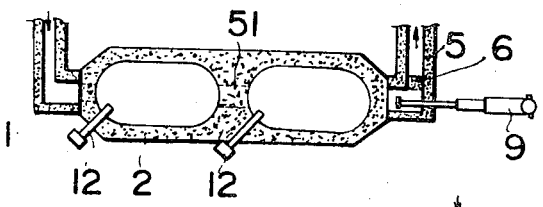
FIGS. 12 and 13 are diagrammatic cross-sectional views showing two types of the combination of the stirring tanks and FIG. 14 is a graph showing the percentage of desulfurization attainable by the method of this invention.

Table 1 below shows the results obtained by using two tanks shown in FIGS. 5 and 6 which were connected in series according to FIG. 12.

Table 1

| Desulfurization agent (calcium carbide) kg/min | Flow rate of pig iron t/min | S content before | S content after | Percentage of desulfurization | Speed r.p.m. |
|---|---|---|---|---|---|
| Each tank | | | | | |
| 3 kg/min | 2 | 0.047 | 0.004 | 91 | 75 |
| 2 kg/min | 2 | 0.035 | 0.007 | 80 | 75 |
| 3 kg/min | 3 | 0.053 | 0.010 | 81 | 75 |

This table shows that a high percentage of desulfurization is possible with a relatively small quantity of calcium carbide.

EXAMPLE 3

The apparatus shown in FIGS. 5 and 6 was modified by adding an oxygen lance as shown in FIG. 7 and dephosphorization was effected with this modified tank under the operation conditions shown in Table 2. Table 3 below shows the results obtained.

Table 2

| Operating Conditions | | |
|---|---|---|
| Flow rate of molten pig iron | Quantity of oxygen blown in | Pressure of oxygen |
| 1 t/min | 12 $m^3$/min | 2.0 $kg/cm^2$ |

| Quantity of Dephosphorization Agents Incorporated (Kg/min) | | | |
|---|---|---|---|
| Lime | Mill scale | Fluorspar | Soda ash |
| 36 | 20 | 6 | 17 |

Table 3

| Results of Treatment | | | | | |
|---|---|---|---|---|---|
| Composition of molten pig iron | | | | Composition of slag | |
| | Before treatment | After treatment | Percentage of removal | | |
| C | 4.40 | 3.64 | 17% | T-Fe | 11.90 |
| Si | 0.87 | 0.02 | 96% | FeO | 8.94 |
| Mn | 0.70 | 0.29 | | $SiO_2$ | 13.88 |
| P | 0.125 | 0.050 | 60% | CaO | 43.19 |

Table 3-continued

| Results of Treatment | | | | | |
|---|---|---|---|---|---|
| Composition of molten pig iron | | | | Composition of slag | |
| | Before treatment | After treatment | Percentage of removal | | |
| S | 0.045 | 0.021 | 53% | P | 0.678 |

The dephosphorization agent was introduced through the chute.

EXAMPLE 4

The tank shown in FIGS. 5 and 6 was modified by providing oxygen lances and stirring vanes shown in FIG. 9 and two such modified tanks are connected in series as shown in FIG. 13 and used for silica removal prior to dephosphorization under the operation conditions shown in Table 4 below. The results are shown in Table 5.

Table 4

| Operating Conditions | | | | |
|---|---|---|---|---|
| | Quantity of oxygen blown in | | Pressure of oxygen blown in | |
| Flow rate of molten pig iron | desilication tank | dephosphorization tank | silica removal tank | dephosphorization tank |
| 1 t/min | 6 $m^3$/min | 11 $m^3$/min | 2.5 kg/$cm^2$ | 1.2 kg/$cm^2$ |

| Silica removal tank | Dephosphorization tank | | | |
|---|---|---|---|---|
| Lime 6 kg/min | Lime 18 kg/min | Mill scale 24 kg/min | Fluorspar 7 kg/min | Soda ash 18 kg/min |

Table 5

| of treatment | | | | | | |
|---|---|---|---|---|---|---|
| Composition of molten pig iron | | | | Composition of slag | | |
| | Before treatment | After treatment | Percentage of removal | | Silica removal tank | Dephosphorization tank |
| C | 4.55 | 3.55 | 22% | T-Fe | 8.4 | 10.06 |
| Si | 0.83 | 0.05 | 94% | FeO | 10.04 | 7.21 |
| Mn | 0.80 | 0.56 | | $SiO_2$ | 48.16 | 16.40 |
| P | 0.132 | 0.035 | 73% | CaO | 16.24 | 40.38 |
| S | 0.042 | 0.018 | | P | 0.015 | 0.80 |

EXAMPLE 5

Ferrosilicon was incorporated into molten pig iron by using the tank shown in FIGS. 5 and 6 and the results are shown in Table 6 below.

Table 6

| Ferrosilicon incorporation test | | | | |
|---|---|---|---|---|
| Flow rate | Quantity of | Content of Si in molten pig iron | | |
| of molten pig iron | ferrosilicon incorporated | Before incorporation | After incorporation | Yield |
| 2 t/min | 36.4 kg/min | 0.70% | 2.00% | 95% |

The ferrosilicon used in this example contained 75% of silicon and 21.7 kg/ton of molten pig iron of this ferrosilicon was added to a runner for conveying molten pig iron discharged from a blast furnace. The yield of the ferrosilicon was 80%. When compared with the yield of 95% shown in Table 6, this datum shows that the novel device is highly efficient.

What is claimed is:

1. A method of continuously refining a material selected from the group consisting of iron and iron alloys comprising the steps of continuously admitting molten pig iron into a stationary stirring tank from one side thereof, said stirring tank having an oval horizontal cross-section and being provided with a plurality of equally spaced apart parallel mechanical vertical stirring means disposed in the longitudinal direction of said oval cross-section, discharging said molten pig iron from the opposite side of said stirring tank thereby causing said molten pig iron to flow in said longitudinal direction, incorporating an additive into said stirring tank and rotating adjacent ones of said stirring means in opposing directions with adjacent ones of said stirring means being in intermeshed relationship such that the loci of adjacent stirring means overlap for stirring the portions of said molten pig iron near the interface between said molten pig iron and said additive thereby effecting admixture of said molten pig iron in said stirring tank due to the flow of said molten pig iron and admixture of said additive with the molten pig iron at said portions near said interface caused by the rotation of said stirring means.

2. The method according to claim 1 wherein a desulfurization agent is admitted into said stirring tank near the inlet port for said molten pig iron.

3. The method according to claim 2 wherein said desulfurization agent comprises calcium carbide.

4. The method according to claim 1 wherein a dephosphorization agent is admitted into said stirring tank in a direction opposite to the direction of flow of the molten pig iron in said stirring tank.

5. The method according to claim 4 wherein said dephosphorization agent comprises lime, fluorspar, mill scale and soda ash.

6. The method according to claim 1 wherein ferrosilicon is admitted into said stirring tank for increasing the content of silicon of said molten pig iron.

7. The method according to claim 1 wherein said molten pig iron is caused to flow through a pair of serially connected stirring tanks and silica removal is performed in one of said stirring tanks whereas dephosphorization is then performed in the other stirring tank.

8. The method according to claim 1 wherein said plurality of stirring means are dipped in the upper portion of said molten pig iron in said tank.

* * * * *